US009319780B2

(12) United States Patent
Macours

(10) Patent No.: US 9,319,780 B2
(45) Date of Patent: Apr. 19, 2016

(54) SMART PASSIVE SPEAKER DRIVE

(71) Applicant: NXP B.V., Eindhoven (NL)

(72) Inventor: Christophe Macours, Leuven (BE)

(73) Assignee: NXP B.V., Eindhoven (NL)

( * ) Notice: Subject to any disclaimer, the term of this patent is extended or adjusted under 35 U.S.C. 154(b) by 113 days.

(21) Appl. No.: 14/250,262

(22) Filed: Apr. 10, 2014

(65) Prior Publication Data

US 2015/0296291 A1 Oct. 15, 2015

(51) Int. Cl.

| | |
|---|---|
| ***H04R 1/10*** | (2006.01) |
| ***H04R 3/00*** | (2006.01) |
| ***H04R 5/033*** | (2006.01) |
| ***H04R 5/04*** | (2006.01) |
| ***H04R 29/00*** | (2006.01) |
| ***H04S 7/00*** | (2006.01) |
| ***H04R 1/06*** | (2006.01) |

(52) U.S. Cl.
CPC .. *H04R 3/00* (2013.01); *H04R 1/06* (2013.01); *H04R 1/1041* (2013.01); *H04R 5/033* (2013.01); *H04R 5/04* (2013.01); *H04R 29/001* (2013.01); *H04S 7/308* (2013.01); *H04R 2420/05* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 6,359,987 | B1 | 3/2002 | Tran et al. | |
| 7,099,481 | B2 * | 8/2006 | Baker | H04R 5/04 381/111 |
| 2012/0121098 | A1 | 5/2012 | Gautama | |
| 2013/0070930 | A1 | 3/2013 | Johnson | |
| 2014/0003616 | A1 | 1/2014 | Johnson et al. | |
| 2014/0093103 | A1 * | 4/2014 | Breece, III | H03F 3/68 381/120 |

OTHER PUBLICATIONS

Extended European Search Report for EP Patent Appln. No. 15159784.6 (May 22, 2015).

* cited by examiner

*Primary Examiner* — Muhammad N Edun
(74) *Attorney, Agent, or Firm* — Rajeev Madnawat

(57) ABSTRACT

A circuit embodied in a mobile device is disclosed. The circuit includes a headphone audio driver, a loudspeaker audio driver and a switch coupled to outputs of the headphone audio driver and the loudspeaker audio driver. The switch is configured to connect the output of the loudspeaker audio driver to an external speaker when an external speaker is connected to the mobile device. The external speaker may be detected using methods such as automatic accessory detection or impedance measurement or a user configuration or a use action. The circuit may also include an impedance detector to drive the switch based on an impedance measurement. A user interface is provided to enable a user of the mobile device to driver the switch based on user preferences.

20 Claims, 4 Drawing Sheets

SMART PASSIVE SPEAKER DRIVE

BACKGROUND

Although the sound reproduction capabilities of mobile devices have improved substantially in the past years, partly due to the use of smart amplifiers, there is still a performance gap compared to external loudspeaker systems. Such portable loudspeakers are widely available in the market and can play audio content from mobile devices through a wireless (typically a Bluetooth™ link) or through a USB cable or a 3.5 mm jack audio cable. Wireless loudspeakers are active speakers that are externally powered by their own power sources. USB based speakers may be USB-powered or can have their own external battery pack or other power source. Portable loudspeakers using a 3.5 mm jack connection are generally battery-powered and can usually be charged using a USB adaptor cable. These wired battery-powered loudspeakers combine the drawbacks of a wired connection and of a battery-powered device. Adding a battery to the external speaker increases cost, size, weight, form factor and extra efforts for charging the batteries. Moreover, once batteries become non-functional, the whole device typically becomes unusable.

There also exist passive (not battery-powered) loudspeakers that can be directly connected to the 3.5 mm headphone jack socket. These do not suffer from the drawbacks of battery-powered loudspeakers, but the limited electrical output (typically max. 100 mW) of the headphone socket does not provide an acceptable sound reproduction level.

In current mobile phone architectures, the headphone amplifier is either a separate integrated circuit (IC) or integrated in an audio "CODEC" IC, which interconnects all audio components (hands-free loudspeakers, earpiece, headphones and microphones) with the main processor through digital and analogue audio interfaces.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, a circuit embodied in a mobile device is disclosed. The circuit includes a headphone audio driver, a loudspeaker audio driver and a switch coupled to outputs of the headphone audio driver and the loudspeaker audio driver. The switch is configured to connect the output of the loudspeaker audio driver to an external speaker when the external speaker is connected to the mobile device The circuit may also include an impedance detector to drive the switch based on an impedance measurement.

In another embodiment, a method executable in a mobile device is disclosed. The method includes measuring impedance of an external speaker connected to the mobile device and connecting a loudspeaker amplifier of the mobile device to the external speaker via a switch when measured impedance is below a pre-selected threshold value.

In yet another embodiment, a mobile device is disclosed. The mobile device includes a headphone audio driver and a loudspeaker audio driver. The mobile device also includes a switch coupled to outputs of the headphone audio driver and the loudspeaker audio driver and a user interface to enable a user of the mobile device to drive the switch based on an user preference.

In yet another embodiment, a computer readable media including programming instructions executable in an mobile device to format an operation is disclosed. The operation includes measuring impedance of an external speaker connected to the mobile device and connecting a loudspeaker amplifier of the mobile device to the external speaker via a switch when measured impedance is below a pre-selected threshold value.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. Advantages of the subject matter claimed will become apparent to those skilled in the art upon reading this description in conjunction with the accompanying drawings, in which like reference numerals have been used to designate like elements, and in which:

DETAILED DESCRIPTION

In mobile devices, the amplifiers driving the hands-free loudspeakers, the earpiece and the headphones typically all integrated in a same integrated circuit (IC). However, they remain functionally completely separated and are usually mutually exclusive (only one can be used at a time). For example, the loudspeaker amplifiers are only used to drive the integrated loudspeakers. It would however be desirable that when a loudspeaker is connected to the headphone jack, the connected loudspeaker could benefit from a much larger electrical capabilities of the integrated amplifiers for the hands-free loudspeakers.

Systems and methods for optimally driving passive loudspeakers connected to the headphone jack output of a mobile device are disclosed. Based on an impedance-based detection of the connected transducer type (headphone or loudspeaker), the jack output is internally routed to the outputs of the appropriate amplifier, namely to the headphone amplifier if a headphone is detected or to the hands-free loudspeaker amplifiers if a loudspeaker is detected. Moreover this allows the external passive loudspeakers to benefit from the same smart audio processing enhancements than the integrated loudspeakers, such as (but not limited to) adaptive equalization based on resonance frequency tracking and distortion-controlled maximization.

Figure 1:
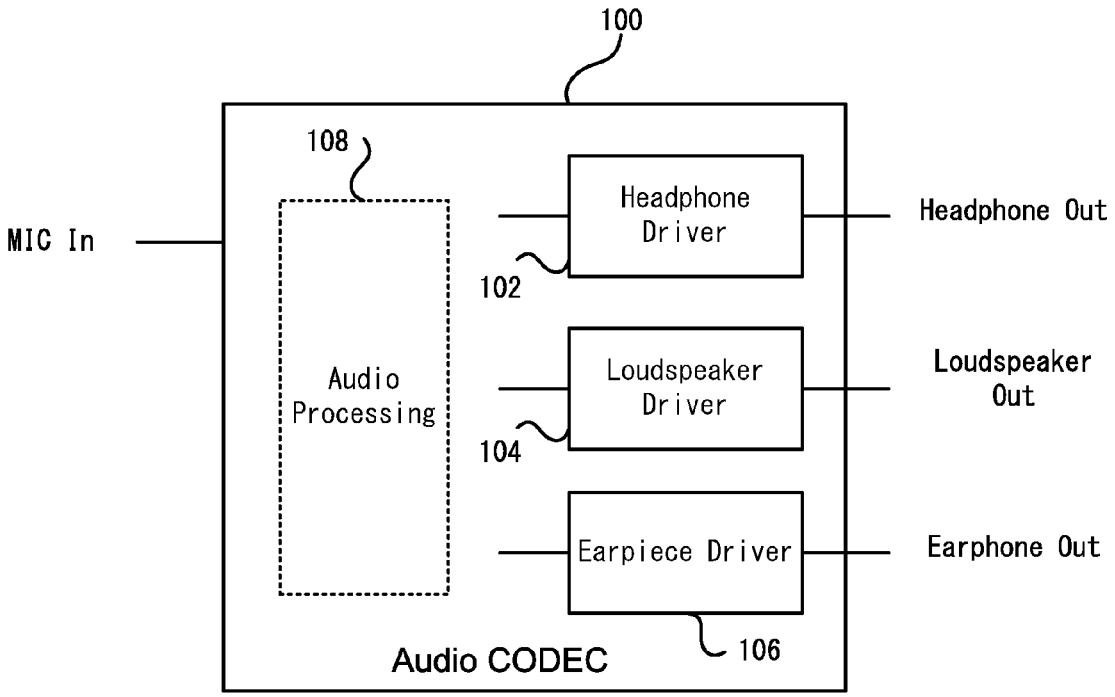
Fig. 1 (Prior Art)
FIG. 1 is a schematic of a traditional mobile audio CODEC in relevant parts.

FIG. 1 is a schematic of a traditional mobile audio CODEC 100. Please note that a mobile audio CODEC includes many other components as for example audio processing components 108. However, those components are being omitted in order not to obfuscate the relevant components. The mobile audio CODEC 100 includes a headphone driver 102, a loudspeaker driver 104 and an earpiece driver 106. These drivers may be coupled to other components that are not being shown in FIG. 1.

The mobile audio CODEC 100 may include a MIC input port. The headphone driver 102 provides preprocessed audio output to a headphone when the headphone is connected to the mobile device. The loudspeaker driver 104 provides preprocessed electrical audio signal to the loudspeaker of the mobile device, when the loudspeaker is turned on. Similarly, the earpiece driver 106 provided preprocessed audio signal to the earpiece of the mobile device. Note that the output audio signals may be mono or stereo. However, in order not to obfuscate the disclosure, this distinction is being omitted because the embodiments described herein can be used for both mono and stereo use.

Figure 2:
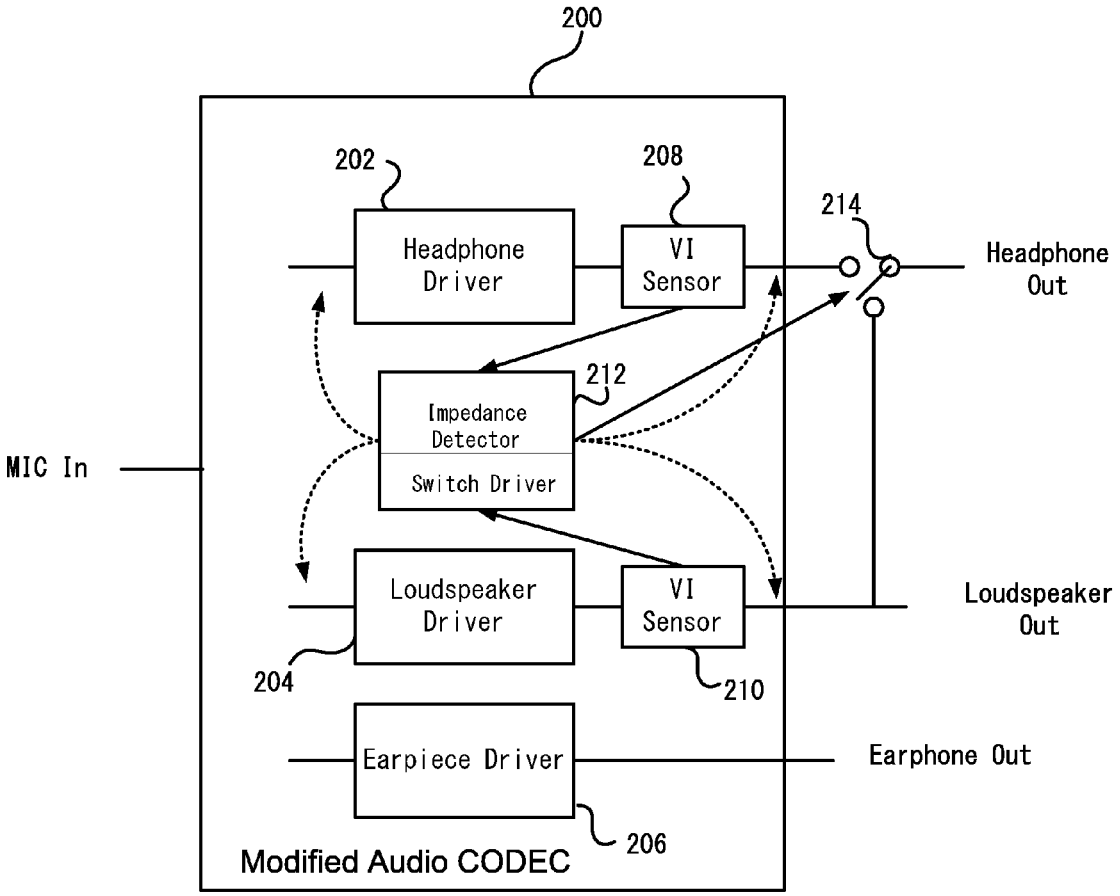
FIG. 2 illustrates an exemplary mobile audio CODEC in relevant parts in accordance with one or more embodiments of the present disclosure.

FIG. 2 illustrates an exemplary modified mobile audio CODEC 200 in relevant parts. Note that many components that are required for the operation of the modified mobile audio CODEC 200 are being omitted so as not to obfuscate the present disclosure. However, a person skilled in the art would realize that the omitted components are not required to be depicted in order to understand various embodiments of the present disclosure.

In one example, the modified mobile audio CODEC 200 includes a headphone driver (or amplifier) 202, a loudspeaker driver 204, and an earpiece driver 206. The modified mobile audio CODEC 200 may also include a MIC input port and outputs from various audio drivers. The modified mobile audio CODEC 200 further includes one or more Voltage (V) and Current (I) Sensors 208, 210 and an impedance detector 212. A switch driver may also be included in the impedance detector 212. In another example, the switch driver can be a separate component that can be driven from the user interface or other modules of the mobile device 200. The other modules may include automatic accessory detection module, optical sensor, etc.

The impedance detector/switch driver 212 is coupled to one or more VI sensors 208, 210. One of the functions of the impedance detector 212 is to measure impedance of the headphone audio path and the loudspeaker audio path based on current and voltage measurements received from one or more VI sensors 208, 210.

The impedance detector 212 is configurable so that a pre-selected impedance threshold value may be inputted to the impedance detector 212. The pre-selected impedance threshold value may be stored in the mobile device by a user of the mobile device or the device vendor or an application vendor.

In one example, the impedance detector/switch driver 212 is activated when the mobile device's automatic accessory detection mechanism detects an external audio device being connected or disconnected from the mobile device. In another example, the impedance detector 212 either continuously or at pre-selected regular intervals, measures the impedance in audio paths. Measurement of impedance of a speaker is well known in the art, hence a detailed description is being omitted.

The modified mobile audio CODEC 200 also includes a switch 214 coupled to the headphone out and the loudspeaker out paths. The switch 214 may be inside or outside the modified mobile audio CODEC 200. The switch 214 is coupled to the impedance detector/switch driver 212. The switch 214 connects the external speaker to the loudspeaker driver 204 according to the impedance measurements on the headphone driver path and the loudspeaker driver path. It may be noted that in some embodiments, the switch 214 may be a software switch embodied in an audio processing software associated with the modified mobile audio CODEC 200.

The modified mobile audio CODEC 200 may also include functionalities such as tracking of the resonance frequency to automatically adapt equalization filters when an external speaker is connected and tracking of loudspeaker non-linearities and to maximize the loudspeaker output up to a predefined level of non-linearities.

Figure 3:
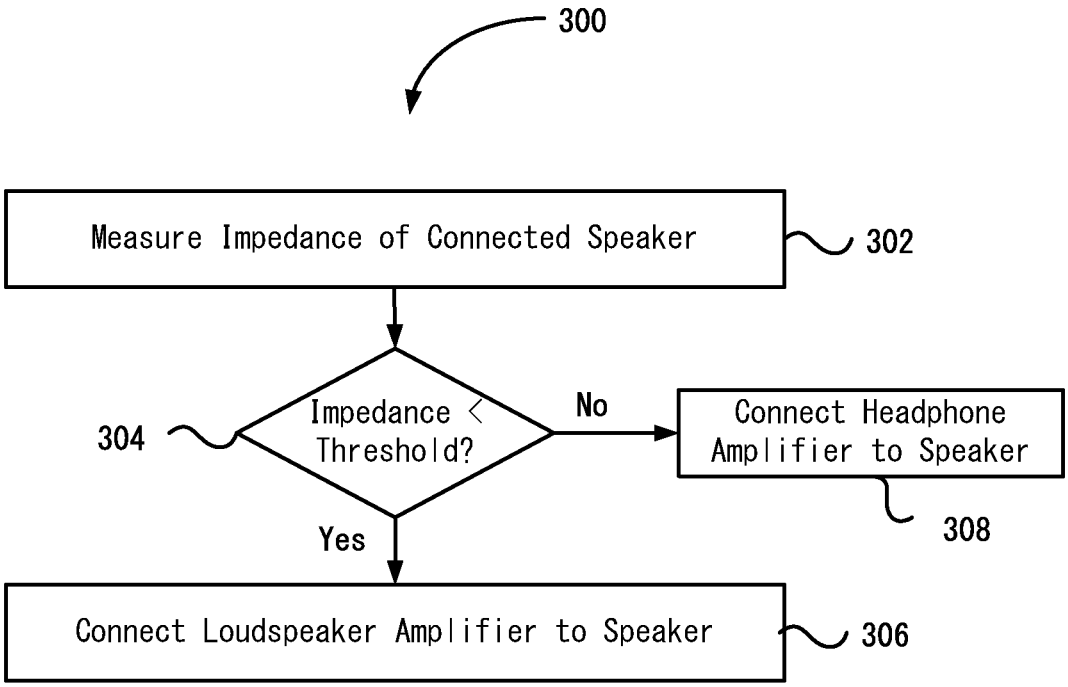
FIG. 3 illustrates an exemplary method of driving a switch according to impedance measurements in accordance with one or more embodiments of the present disclosure.

FIG. 3 illustrates an exemplary method 300 of driving a switch according to impedance measurements. Accordingly, at step 302, the impedance of the external speaker that is connected to the mobile device via the headphone jack or via USB or wirelessly, is measured. In one example, step 302 is executed when the mobile device detects an accessory being attached to the mobile device and if the accessory being attached is an audio device. If no external speaker is connected to the mobile device, no further operations of the method 300 are performed. At decision step 304, if the measured impedance is below a pre-selected threshold value, at step 306, the loudspeaker driver or amplifier 204 is connected to the external speaker. Otherwise, at step 308, the headphone driver or amplifier 202 is connected to the externally connected listening device that may be a speaker or a headphone. It should be noted that in other embodiments, the logic may be configured to compare the measured impedance with the pre-selected threshold value and connect the loudspeaker driver to the external speaker based on the comparison. In another embodiment, the impedance detector/switch driver 212 is not used. Instead, a user of the mobile device may use the user interface of the mobile device to connect the loudspeaker driver to the external speaker. For example, the user interface may enable the user to set preferences to enable/disable connecting the loudspeaker driver to the external speaker.

It should be noted that the process of impedance detection described herein is one of the methods that can be used to detect an external speaker when the external speaker is connected to the mobile device. In other embodiments, the external speaker may be detected using methods such as an automatic accessory detection or optical sensing or a user configuration or a user action, etc. In one example, every time an external accessory is connected to the mobile device, the mobile device may display a message on the user interface of the mobile device asking the user to confirm if the externally connected device is a speaker and asking the user to confirm if the internal speakerphone audio driver is to be used. If the user confirms affirmatively, the switch 214 is operated to connect the external device to the speaker phone audio driver 204. Therefore, the switch driver 213 may be operated by using the user inputs, user configuration or automatic accessory detection circuit.

Figure 4:
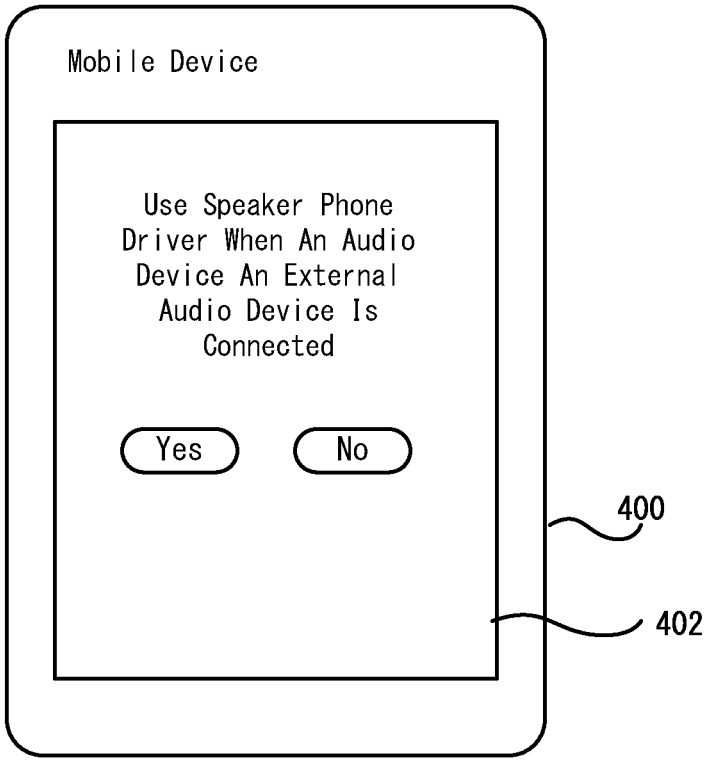
FIG. 4 illustrates an exemplary user interface for setting user preferences for using a loudspeaker driver in accordance with one or more embodiments of the present disclosure.

FIG. 4 illustrates an exemplary user interface of a mobile device 400. In this example, the mobile device 400 includes the modified mobile audio CODEC 200 as depicted in FIG. 2. The mobile device also includes a device configuration user interface 402 to enable a user to save configuration to instruct the switch 214 to connect the loudspeaker driver 204 to an external audio device that connects to the mobile device 400. The user may turn this configuration on or off using the user interface 402. In this example, the modified mobile audio CODEC 200 may not include a circuit for impedance detection. Instead, the switch driver will be driven based on the user configurations set by the user via the user interface 402. In another embodiment, if the modified mobile audio CODEC 200 includes the circuit for impedance detection, the configurations set via the user interface 402 will override the automatic switching performed by the impedance detector/switch driver 212.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. A circuit embodied in a mobile device, comprising:
a headphone audio driver;
a loudspeaker audio driver; and
a switch coupled to outputs of the headphone audio driver and the loudspeaker audio driver, wherein the switch is configured to connect, based on a user configuration stored in the mobile device, the output of the loudspeaker audio driver to an external speaker when the external speaker is connected to the mobile device, wherein the switch is configured to connect the output of the headphone audio driver to an external headphone when the external headphone is connected to the mobile device.

2. The circuit of claim 1, further comprising an impedance detector to drive the switch based on an impedance measurement.

3. The circuit of claim 2, wherein the impedance detector is configured to measure impedance of an audio device connected to the headphone audio driver and the loudspeaker audio driver.

4. The circuit of claim 3, wherein the impedance detector is configured to measure impedance based on voltage and current measurements at the outputs of the headphone audio driver and the loudspeaker audio driver.

5. The circuit of claim 2, wherein the impedance detector drive the switch to connect the loudspeaker audio driver to the external speaker when impedance of the external speaker is less than a pre-selected threshold value.

6. The circuit of claim 2, wherein the headphone audio driver, the loudspeaker and the impedance detector are embodied in an audio CODEC integrated circuit.

7. The circuit of claim 2, wherein the impedance measurement is performed continuously at regular intervals.

8. The circuit of claim 2, wherein the impedance measurement is performed only when an external speaker is detected by the mobile device.

9. The circuit of claim 1, wherein the switch is embodied in an audio CODEC integrated circuit.

10. The circuit of claim 1, wherein the switch is embodied in an audio processing software.

11. A method executable in a mobile device, the method comprising:
measuring impedance of an external speaker connected to the mobile device; and
based on a user configuration stored in the mobile device, connecting a loudspeaker amplifier of the mobile device to the external speaker via a switch when measured impedance is below a pre-selected threshold value and connecting a headphone audio amplifier to an external headphone via the switch when the measured impedance is above the pre-selected threshold value.

12. The method of claim 11, wherein if the measure impedance is above the pre-selected threshold value, a headphone audio driver of the mobile device is connected to the external speaker.

13. The method of claim 11, wherein the measuring is performed continuously at regular intervals.

14. The method of claim 11, wherein the measuring is performed only when the external speaker is detected by the mobile device.

15. The method of claim 11, wherein the pre-selected threshold value is configurable by a user of the mobile device.

16. A mobile device, comprising:
a headphone audio driver;
a loudspeaker audio driver;
a user interface to enable a user of the mobile device to drive the switch based on an user preference; and
a switch coupled to outputs of the headphone audio driver and the loudspeaker audio driver, wherein based on the user preference, the switch is configured to connect the output of the loudspeaker audio driver to an external speaker when the external speaker is connected to the mobile device and the switch is configured to connect an output of the headphone audio driver to an external headphone when the external headphone is connected to the mobile device.

17. The mobile device of claim 16, wherein the user preference is used to drive the switch to connect the loudspeaker audio driver to an external speaker.

18. The mobile device of claim 16, wherein the user interface includes controls for turning on or off driving the switch based on the user preference.

19. The mobile device of claim 16, wherein the headphone audio driver and the loudspeaker are embodied in an audio CODEC integrated circuit.

20. The mobile device of claim 16, wherein the switch is embodied in an audio CODEC integrated circuit.

* * * * *